US006788796B1

(12) United States Patent
Miles et al.

(10) Patent No.: US 6,788,796 B1
(45) Date of Patent: Sep. 7, 2004

(54) DIFFERENTIAL MICROPHONE

(75) Inventors: Ronald Miles, Newark Valley, NY (US); Sanjay Sundermurthy, Eden Prairie, MN (US); Colum Gibbons, East Northport, NY (US); Ronald Hoy, Ithaca, NY (US); Daniel Robert, Bristol (GB)

(73) Assignee: The Research Foundation of the State University of New York, Albany, NY (US)

( * ) Notice: Subject to any disclaimer, the term of this patent is extended or adjusted under 35 U.S.C. 154(b) by 195 days.

(21) Appl. No.: 09/920,664

(22) Filed: Aug. 1, 2001

(51) Int. Cl.[7] ..... H04R 25/00

(52) U.S. Cl. ..... 381/357; 381/356; 381/353

(58) Field of Search ..... 381/353, 355, 381/356, 357, 312, 313

(56) References Cited

U.S. PATENT DOCUMENTS 3,573,400 A * 4/1971 Sessler et al. ..... 381/357
5,703,957 A * 12/1997 McAteer ..... 381/92
5,878,147 A * 3/1999 Killion et al. ..... 381/313

OTHER PUBLICATIONS

Cornell News: "Super fly lends an ear to bio–inspired hearing aids and robotic listening devices, Cornell neuroscientist report." pp. 1–3 http://www.news.cornell.edu/releases/March01/fly_ear.html.*

Binghamton University's. Inside Research article : "On the fly" pp. 1, 14–15. http://www.binghamton.edu.*

Proceedings of IMECE: "Design of Biomimetic directional microphone diaphragm" by C. Gibbons and R. Miles. copyright Nov. 5–10, 2000, pp. 1–7.*

World Scientific: "A mechanical analysis of hte novel ear of the parasitoid fly Ormia ochracea" by R. Miles, T. Tieu, D. Robert, and R. Hoy. copyright 1997. pp. 1–7.*

Thesis: "Diaphragm design for biomimetic acoustic sensor" by Sanjay Sundermurthy. pp. 1–77.*

* cited by examiner

*Primary Examiner*—Curtis Kuntz
*Assistant Examiner*—P. Dabney
(74) *Attorney, Agent, or Firm*—Mark Levy & Associates; David L. Banner

(57) ABSTRACT

A new acoustic sensing device or directional microphone having greater sensitivity and reduced noise. The directional microphone or acoustic sensor has a rigid, one micron thick, polysilicon membrane having dimensions of about 1 mm×2 mm. The membrane is supported upon its center by rigid supports having torsional and transverse stiffness. The differential microphone is useful in hearing aids, telecommunications equipment, information technology and military applications.

24 Claims, 7 Drawing Sheets

DIFFERENTIAL MICROPHONE

FIELD OF THE INVENTION

The present invention relates to microphones and, more particularly, to a new differential!microphone having improved frequency response and sensitivity characteristics.

BACKGROUND OF THE INVENTION

The most common approach to constructing a directional microphone is provided by an apparatus comprising sound inlet ports defined by juxtaposed tubes that communicate with a diaphragm. The two sides of the microphone diaphragm receive sound from the two inlet ports. The sound pressure driving the rear of the diaphragm travels through a resistive material that provides a time delay. The dissipative, resistive material must be designed to create a proper time delay in order for the net pressure to have the desired directivity.

It is important that the net pressure on the directional microphone is proportional to the frequency of the sound, and thus has a 6 dB per octave slope. The net pressure is: also diminished in proportion to the distance between the ports. Reducing the overall size of the diaphragm results in a proportional loss of sensitivity. It can be observed that the 6 dB per octave slope and the dependence on the distance dimension remain even in microphones devoid of the resistive material. A microphone without the resistive material is normally called a differential microphone or a pressure gradient microphone.

Directional microphones, which are commonly used in hearing aids, are normally designed to operate below the resonant frequency of the diaphragm. This causes the response to have roughly the same frequency dependence as the net pressure. As a result, the microphone output is proportional to frequency, as is the net pressure.

The uncompensated directional output exhibits a 6 dB per octave high pass filter shape. To correct for this frequency response characteristic, a 6 dB per octave low pass filter is incorporated in the hearing aid device, along with a gain stage. This yields a "flat" response. The microphone package incorporates a switch to allow the user to select between the two response curves.

The problem of electronically compensating for the 6 dB per octave slope of the diaphragm response is that it causes a substantial degradation in noise performance. Any thermal noise introduced by the microphone itself, along with the noise created by the buffer amplifier, is amplified by the gain stage in the compensation circuit. The significant increase in noise is very undesirable.

Hearing aid manufacturers have found it necessary to incorporate switches on hearing aids that allow users to switch to a non-directional microphone mode in quiet environments, where the directional microphone noise proves most objectionable.

The noise inherent in conventional, directional microphones has caused hearing aid microphone designers to use a relatively large port spacing of approximately 12 mm. This is considered to be the largest port spacing that can be used while still achieving directional response at 5 kHz, the highest frequency for speech signals.

Creating small directional microphones is dependent upon the product of frequency and port spacing. The distance factor indicates that sensitivity of the device is reduced as its overall size is reduced.

Traditionally, compensating the output signal to achieve a flat frequency response has been traditionally accomplished electronically. This has lead to the amplification of noise sources.

The present invention seeks a new approach to solving the aforementioned problems. It has been discovered that the mechanical structure employed in the directionally sensitive ears of the fly, Ormia ochracea, can act as a model for a hearing aid microphone having sound sensitivity without drastic amounts of frequency compensation. A diaphragm patterned after the Ormia ochracea ears is very well suited to silicon microfabrication technology.

The current invention provides a directional microphone having a one micron thick silicon membrane with dimensions of approximately 1 mm×2 mm. The directional microphone has improved sensitivity, a reduced noise level, and a frequency response that is comparable to existing high performance miniature microphones.

SUMMARY OF THE INVENTION

In accordance with the present invention, there is provided an improved directional microphone or acoustic sensor having greater sensitivity and reduced noise. The directional microphone or acoustic sensor comprises a rigid, one micron thick polysilicon membrane having dimensions of approximately 1 mm×2 mm. The membrane is supported upon its central axis by beams having torsional and transverse stiffness. The total damped area of the microphone is between approximately 1.5 and $2.5\times10^{-6}$ $m^2$. The distance between centers of the two sides of the device is approximately $10^{-3}$ m. The resonant frequency in the rotational mode is in a range of between approximately 700 to 1,000 Hz, and the resonant frequency of the translational mode is in the range of between approximately 40,000 and 45,000 Hz. The total mass of the device is between approximately 2.0 and $3.0\times10^{-8}$ kg. The mass moment of inertia about an axis through the supports is in a range of between approximately 9.0 and $10\times10^{-15}$ $kgm^2$. The damping constant is in a range of between approximately 9.5 and $10\times10^{-5}$ N-s/m, and is designed to provide critical damping. The signals from the microphone are filter compensated to achieve a flat frequency response over a range, typically between the 250 and 8,000 Hz octave bands.

It is an object of this invention to provide an improved acoustic device.

It is another object of the invention to provide a directional microphone or acoustic sensor of new design, having higher sensitivity and lower noise than do conventional directional microphones.

It is an additional object of the invention to provide a directional microphone which may be fabricated using silicon microfabrication techniques.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a new, miniature acoustic sensing device or directional microphone having greater sensitivity and reduced noise. The directional microphone or acoustic sensor comprises a rigid, one micron thick, polysilicon membrane having dimensions of about 1 mm×2 mm. The membrane is supported upon its center by beams having torsional and transverse stiffness.

Figure 1:
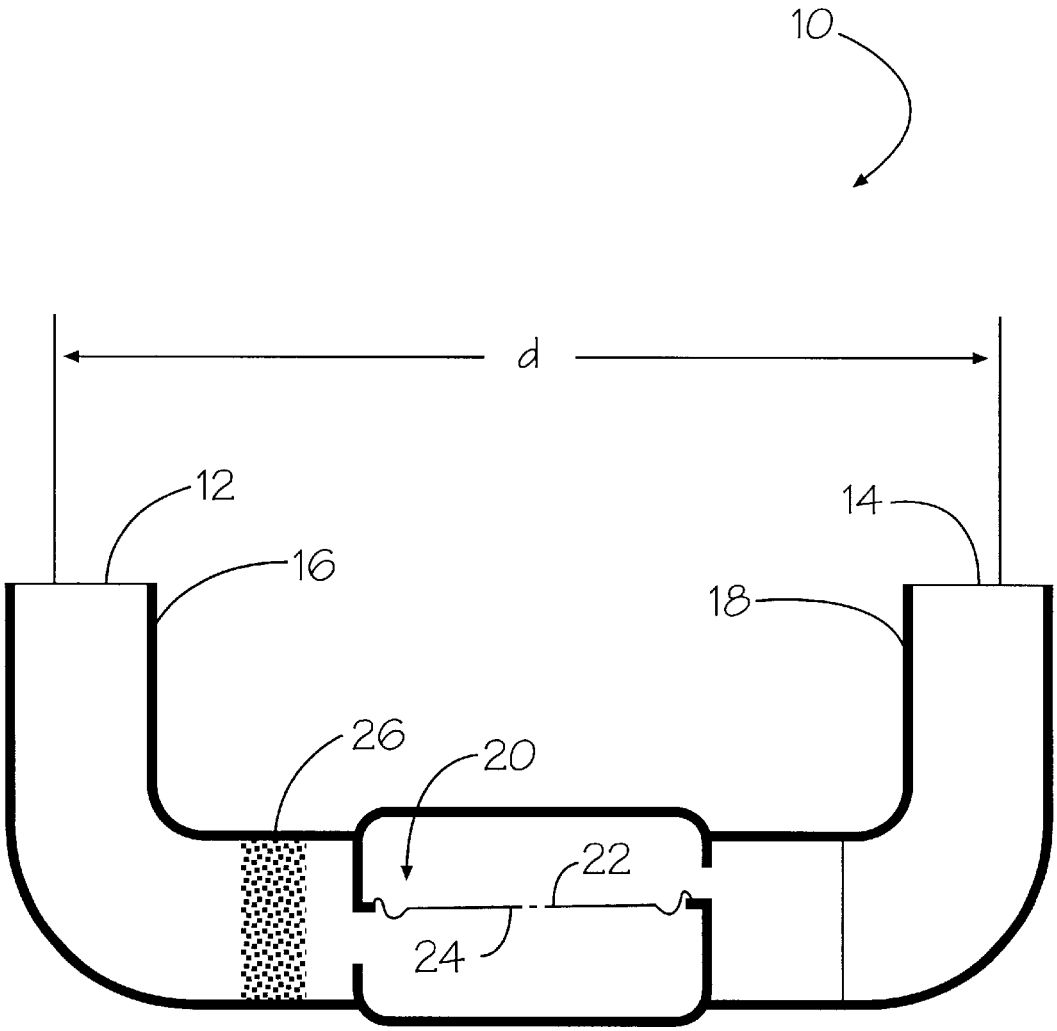
PRIOR ART Figure 1
FIG. 1 illustrates a schematic, sectional view of a conventional directional microphone.

Now referring to FIG. 1, a schematic of a conventional directional microphone 10 is illustrated. The most common directional microphone 10 has directivity in the approximate shape of a cardioid. The sound inlet ports 12 and 14, respectively, are spaced a distance "d" apart, and are defined by juxtaposed tubes 16 and 18 that communicate with the diaphragm 20. The two sides 22 and 24, respectively, of the microphone diaphragm 20 receive sound from the two respective inlet ports 12 and 14. The sound pressure driving the rear of the diaphragm travels through a resistive material, or damping screen 26, designed to provide a time delay. The dissipative, resistive material must be designed to create a proper time delay in order for the net pressure to have the desired directivity.

The ports, which are separated by a distance d, as aforementioned, create a net pressure on the diaphragm that may be expressed as:

$$p_{net}(t) = P_{net}e^{\hat{i}\omega t} = P\left(1 - e^{-\hat{i}\left(\omega\tau + \frac{d}{c}\omega\cos(\phi)\right)}\right)e^{\hat{i}\omega t} \tag{I.1}$$

where $i=\sqrt{-1}$, ω is the frequency of the sound in radians/second, c is the sound speed, ϕ is the angle of incidence, and τ is a time delay introduced by the resistive material. Since the time delay τ and the distance "d" between the ports 12 and 14 is quite small, the argument of the exponential is small, and allows equation (1.1) to be approximated by:

$$P_{net} \approx P\left(1 - 1 + \hat{i}\left(\omega\tau + \frac{d}{c}\omega\cos(\phi)\right)\right) = P\hat{i}\left(\omega\tau + \frac{d}{c}\omega\cos(\phi)\right). \tag{I.2}$$

The dissipative material must be designed to create the proper time delay in order for the net pressure to have the desired directivity. If the resistive material 26 is represented by an equivalent low-pass electronic circuit, the transfer function of the material is:

$$H = \frac{1}{1 + \hat{i}\omega RC} \tag{I.3}$$

where R is the equivalent resistance, and C is the equivalent capacitance. The phase delay due to this circuit is:

$$\psi = -\arctan(\omega RC) \tag{I.4}$$

and the time delay is given by:

$$\tau = \frac{d\phi}{d\omega} = \frac{1}{1 + (\omega RC)^2}\frac{1}{RC} \tag{I.5}$$

Operating the filter in the pass-band (ω<1/(RC)) leads to a time delay of $$t \approx \frac{1}{RC}.$$

If the resistive material is selected to create a time delay given by τ=d/c, the net pressure becomes:

$$P_{net} \approx \hat{i}\omega\frac{d}{c}(1 + \cos(\phi)). \tag{I.6}$$

The term 1+cos(ϕ) gives the familiar cardioid directivity pattern.

It is important to note that the net pressure on the directional microphone is proportional to ω, and thus has a 6 dB per octave slope. The net pressure is also diminished in proportion to the distance "d" between the ports. Reducing the overall size of the sensor thus results in a proportional loss of sensitivity. Note that the 6 dB per octave slope and the dependence on dimension "d" remains even in microphones without the resistive material (τ=0) in equation (I.2). A microphone without the resistive; material is normally called a differential microphone or a pressure gradient microphone.

Figure 2:
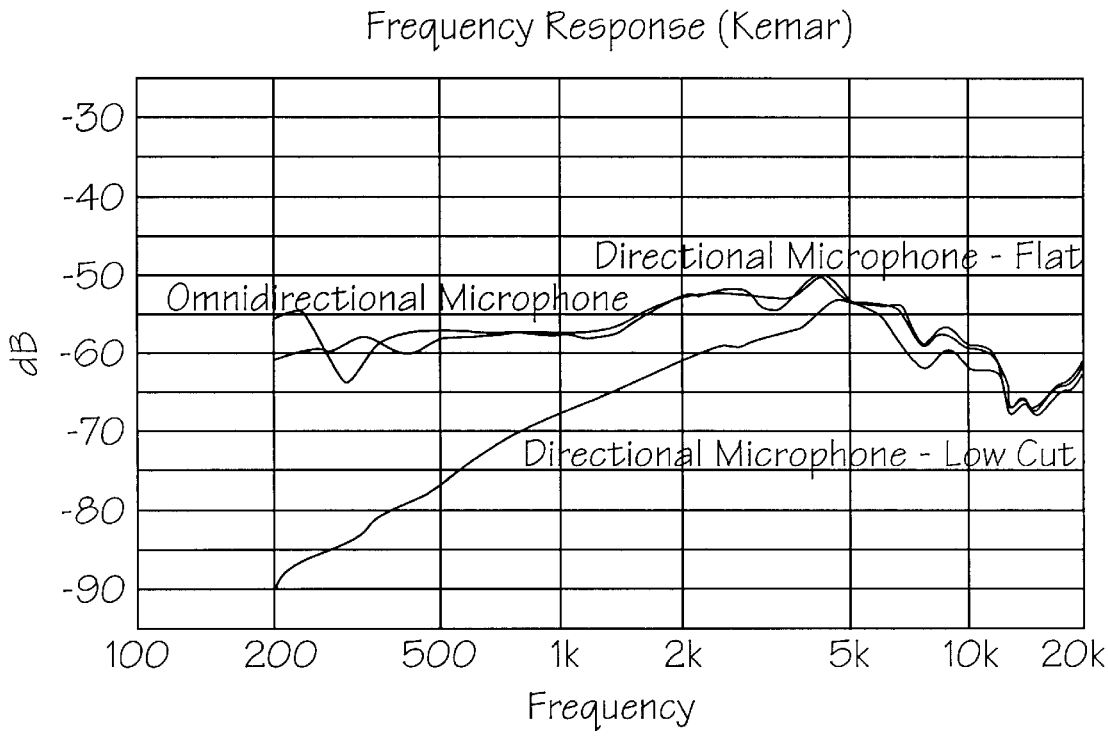
FIG. 2 depicts a graph of a measured directional hearing aid microphone response.

Directional microphones are normally designed to operate below the resonant frequency of the diaphragm 20, which causes the response to have roughly the same frequency dependence as the net pressure. As a result, the microphone output is proportional to frequency, as in the net pressure in equation (I.6). This is illustrated in FIG. 2, which shows measured response of a commercially available directional microphone for hearing aids. The curve labeled "low cut" corresponds to the uncompensated directional output, and exhibits a 6 dB per octave high pass filter shape. In order to correct for this frequency response characteristic, a 6 dB per octave low pass filter is incorporated along with a gain stage to yield the "flat" response curve shown. The microphone 10 incorporates a switch to allow a user to select between the two response curves.

Although the 6 dB per octave slope of the diaphragm response can be electronically compensated it order to achieve a flat frequency response, this leads to a substantial degradation in noise performance. Any thermal noise introduced by the microphone itself, along with the 1/f noise created by the buffer amplifier, is amplified by the gain stage in the compensation circuit. This is a significant increase in noise, and is very undesirable in a directional microphone. Hearing aid manufacturers have found it necessary to incorporate switches on hearing aids to allow the user to switch to a nondirectional microphone in quiet environments, where the directional microphone noise proves objectionable.

The noise inherent in conventional directional microphones has caused hearing aid microphone designers to utilize a relatively large port spacing "d", of approximately d≈12 mm. This is considered to be the largest port spacing that can be used while still achieving directional response at 5 kHz, which is the highest frequency for speech signals.

The primary difficulties in creating small directional microphones result from the product ωd in equation (I.6).

Compensation of the output signal to achieve a flat frequency response is always accomplished electronically. Th;is leads to the amplification of noise sources. The factor "d" indicates that the sensitivity of the device 10 is reduced as its overall size is reduced.

The invention solves these problems, by using a new mechanical structure patterned after the directionally sensitive ears of the fly Ormia ochracea. The new mechanical approach reduces the need for drastic amounts of frequency compensation. The new diaphragm design concept is very well suited for silicon microfabrication technology.

Figure 3B:
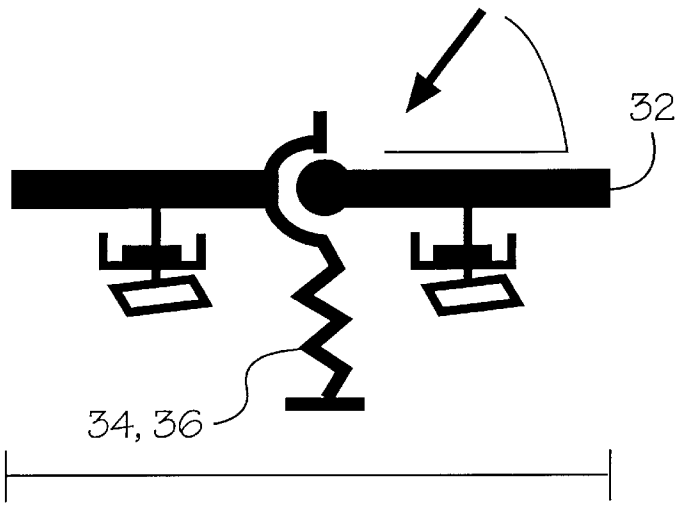
FIGS. 3*a* and 3*b* show schematic, perspective and front views, respectively, of the sensing device of this invention.
Figure 3A:
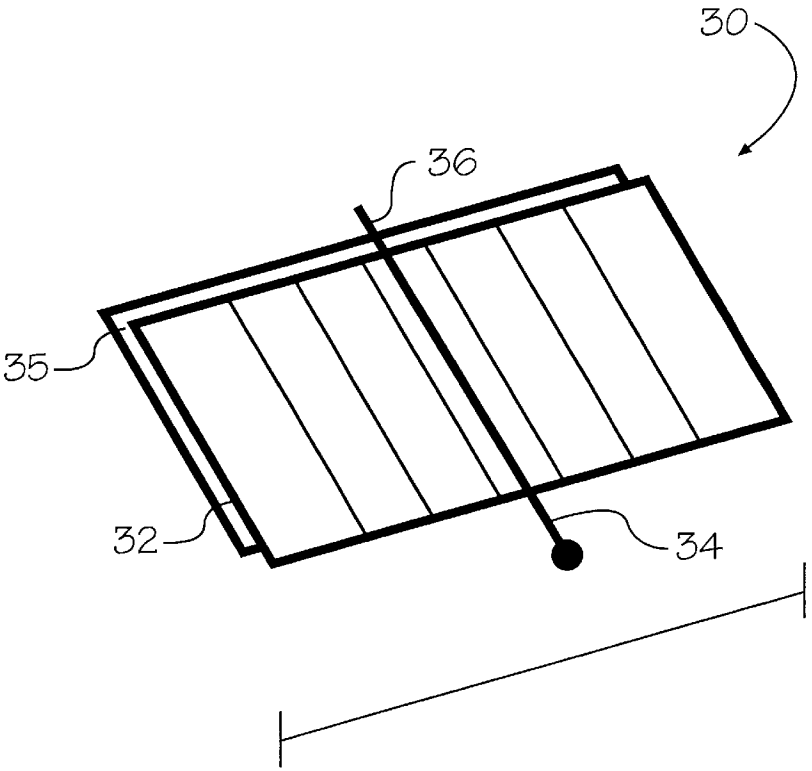

As explained hereinafter, with reference to FIGS. 3*a* and 3*b*, a directional microphone 30 has dimensions of 1 mm×2 mm, and has a sensitivity, noise, and frequency response that is comparable to existing high performance miniature microphones.

The analysis of the microphone 30 is based on a lumped parameter model in which the parameters of the structure are obtained through a detailed finite element analysis. The microphone 30 has a rigid diaphragm 32 that is supported by flexible hinges 34 and 36, respectively. The diaphragm 32 has two degrees of freedom. Motion can be represented by rotation about the centerline "θ" and the displacement of the midpoint "x". The equations of motion are:

$$I[|\$]\$^{\cdot\cdot}g\ddot{v}+k_t\theta+2r(d/2)^2\hat{\theta}=(f_1-f_2)d/2m\ddot{x}+kx+2r\dot{x}=f_1+f_2 \quad \text{(II.1)}$$

where I is the mass moment of inertia about the pivot, $k_t$ is the torsional spring constant of the support, r is the mechanical dashpot constant, f1 and f2 are the effective forces on each side due to sound pressure, m is the mass of the diaphragm 32, and k is the transverse spring constant of supports 34 and 36. If ϕ is the angle of incidence of the plane acoustic wave, the forces may be expressed as:

$$f_1=Ps/2e^{\hat{i}\omega(t+d/2\ \cos(\phi)/c)}=F_1e^{\hat{i}\omega t},$$

$$f_2=Ps/2e^{\hat{i}\omega(t-d/2\ \cos(\phi)/c)}=F_2e^{\hat{i}\omega t}, \quad \text{(II.2)}$$

where s/2 is the effective area of each side of the diaphragm 32, c is the speed of sound and $i=\sqrt{-1}$. Using equations (II.2), the right sides of equations (II.1) become:

$$(f_1-f_2)d/2=d/2Ps\hat{i}\ \sin(\omega d/2\ \cos\ (\phi)/c)e^{\hat{i}\omega t}\approx Ps\hat{i}\omega(d/2)^2\cos(\phi)/ce^{\hat{i}\omega t},$$

$$f_1+f_2=Ps\ \cos(\omega d/2\ \cos(\phi)/c)\ e^{\hat{i}\omega t}\approx Pse_{i\omega t}, \quad \text{(II.3)}$$

where it has been assumed that since d is very small relative to the wavelength of sound, $$\omega d/2\ \cos(\phi)/c<<1. \quad \text{(II.4)}$$

Equations (II.1), (II.2), and (II.3) enable the solutions for θ and x to be written as:

$$\theta=\Theta e^{\hat{i}\omega t},\ x=Xe^{\hat{i}\omega t}, \quad \text{(II.5)}$$

where $$\Theta=\frac{Ps\hat{i}\omega(d/2)^2\cos(\phi)/c}{k_t-\omega^2 I+\hat{i}\omega 2r(d/2)^2}=\frac{Ps\hat{i}\omega(d/2)^2\cos(\phi)/(cI)}{\omega_1^2-\omega^2+\hat{i}\omega 2\omega_1\zeta_1}\ \text{and} \quad \text{(II.6)}$$

$$X=\frac{Ps}{k-\omega^2 m+\hat{i}\omega 2r}=\frac{Ps/m}{\omega_2^2-\omega^2+\hat{i}\omega 2\omega_2\zeta_2} \quad \text{(II.7)}$$

$\omega_1$ and $\omega_2$ are the resonant frequencies of the rotational and translational modes, respectively, and $\zeta_1$ and $\zeta_2$ are the damping ratios. The dashpot constant may be related to the properties of the rotational mode by:

$$\tau=\frac{\omega_1\zeta_1 I}{(d/2)^2}. \quad \text{(II.8)}$$

Note that the total equivalent dashpot constant is R=2r, since two dashpots are provided with dashpot constants r.

The displacements of the middle of each side of the microphone are given by:

$$x_1=X_1e^{\hat{i}\omega t}=x+\frac{d}{2}\theta=\left(X+\frac{d}{2}\Theta\right)e^{\hat{i}\omega t}$$

$$x_2=X_2e^{\hat{i}\omega t}=x-\frac{d}{2}\theta=\left(X-\frac{d}{2}\Theta\right)e^{\hat{i}\omega t} \quad \text{(II.9)}$$

From equations (II.6) and (II.7), $$X_1=\frac{Ps/m}{\omega_2^2-\omega^2+\hat{i}\omega 2\omega_2\zeta_2}+\frac{d}{2}\frac{Ps\hat{i}\omega(d/2)^2\cos(\phi)/(cI)}{\omega_1^2-\omega^2+\hat{i}\omega 2\omega_1\zeta_1}. \quad \text{(II.10)}$$

If the supports are designed so that $\omega_2$ is larger than the frequencies of interest, the first term in equation (II.10) can be neglected to obtain:

$$X_1=\frac{Ps\hat{i}\omega(d/2)^2\cos(\phi)/(cI)}{\omega_1^2-\omega^2+\hat{i}\omega 2\omega_1\zeta_1}. \quad \text{(II.11)}$$

The overall sensitivity S may be obtained by multiplying the mechanical sensitivity given in equation (II.11) by $V_b/h$ where $V_b$ is the bias voltage and "h" is the thickness of the gap between the diaphragm and the biased backplate. Since the goal is to detect the pressure difference and minimize the effect of the average pressure, it is advantageous to sense the difference $x_1-x_2=d\theta$.

This also provides a factor of two increase in sensitivity, and helps to minimize the effects of electromagnetic noise sources. The overall sensitivity is then obtained using equation (II.6), $$S=\frac{X_1-X_2}{P}\frac{V_b}{h}=\frac{V_b 2s\hat{i}\omega(d/2)^3\cos(\phi)/(cIh)}{\omega_1^2-\omega^2+\hat{i}\omega 2\omega_1\zeta_1} \quad \text{(II.12)}$$

From equation (II.12), it appears that there is a very strong dependence on the distance "d" between the centers of the two sides. To examine the sensitivity to this parameter, it is important to note that while the mass moment of inertia "I" depends on the details of the mass distribution in the diaphragm, "I" can be roughly estimated by considering the mass on each side of the diaphragm to be concentrated at a distance d/2 from the pivot point. This gives $I\approx(d/2)^2m$, so that equation (II.12) becomes $$S\approx\frac{V_b ds\hat{i}\omega\cos(\phi)/(cmh)}{\omega_1^2-\omega^2+\hat{i}\omega 2\omega_1\zeta_1}. \quad \text{(II.13)}$$

The total sensitivity is thus roughly proportional to the distance "d", and the area "s", and is inversely proportional to the total mass, "m".

Noise Estimation

The equivalent dBA sound pressure level due to thermal noise in the microphone may be computed from:

$$N \approx 132.5 + 10 \log_{10}(4k_b TR/s^2) \quad \text{(II.14)}$$

where $k_b$ is Boltzmann's constant ($1.38\times10^{-23}$) J/K, T is the absolute temperature, and "s" is the area over which the dashpots act. In equation (II.14) it has been taken into consideration that there are two dashpots having dashpot constants "r", so that the total equivalent dashpot constant is R=2r. From equation (II.8), the fact that $I \approx (d/2)^2 m$ leads to:

$$r = \frac{\omega_1 \zeta_1 I}{(d/2)^2} \approx \omega_1 \zeta_1 m. \quad \text{(II.15)}$$

Combining equations (II.14) and (II15) gives $$N \approx 132.5 + 10 \log_{10}(8k_b T \omega_1 \zeta_1 m/s^2) \quad \text{(II.16)}$$

Equation (II.16) shows that;,the noise is minimized by designing a structure with a low resonant frequency for rotational motion, $\omega_1$. The damping ratio $\zeta_1$ should be as small as possible without resulting in unacceptable transient response. It is reasonable to design the damping in the system so that it is slightly overdamped, giving $\zeta_1 \approx 1$. As noted above, it is preferred to construct a diaphragm with the smallest mass "m" possible.

Comparison with a Conventional Differential Microphone

Consider a conventional differential microphone shown schematically in FIG. 1, without the damping screen 26. This causes $\tau=0$ in equation (I.2), so that the net pressure becomes:

$$P_{net} \approx P\hat{\imath}\omega \frac{d}{c}\cos(\phi). \quad \text{(III.1)}$$

The directivity pattern of this microphone is determined by $\cos(\phi)$, which gives it the shape of a figure eight, as expected for a differential microphone. Assume that the diaphragm is fabricated using a "conventional" approach so that it consists of a 1 $\mu$m silicon membrane having dimensions 1×2 mm. The displacement of the diaphragm can be approximated by:

$$\ddot{x}_0 + \omega_0^2 x_0 + 2\omega_0\zeta_0\dot{x}_0 = P_{net}\alpha s_0 / m_0 e^{\hat{\imath}\omega t}, \quad \text{(III.2)}$$

where $\omega_0$ is the natural frequency, $\zeta_0$ is the damping ratio, $s_0$ is the area, and $m_0$ is the total mass. If it is assumed that the edges of the diaphragm are clamped, the mode shape can be taken to be the product of the eigenfunctions for a clamped-clamped beam. This gives:

$$\alpha = \frac{\int_0^{l_x}\int_0^{l_y}\phi(x/l_x)\phi(y/l_y)dxdy}{\int_0^{l_x}\int_0^{l_y}\phi(x/l_x)^2\phi(y/l_y)^2 dxdy}, \quad \text{(III.3)}$$

where $$\phi(z) = \cos(pz) - \cos h(pz) + D(\sin(pz) - \sin h(pz)) \quad \text{(III.4)}$$

where p=4.730040745, and D=−0.982502215. Carrying out the integrations in equation (III.3) gives:

$$\int_0^{l_x}\int_0^{l_y}\phi(x/l_x)\phi(y/l_y)dxdy = 0.6903 s_0, \quad \text{(III.5)}$$

and $$\int_0^{l_x}\int_0^{l_y}\phi(x/l_x)^2\phi(y/l_y)^2 dxdy = s_0, \quad \text{(III.6)}$$

so that $\alpha=0.6903$.

As in equation (II.15), if $$x_0 = X_0 e^{\hat{\imath}\omega t}, \quad \text{(III.7)}$$

then the complex amplitude of the response becomes:

$$X_0 = \frac{P_{net}\alpha s_0/m}{\omega_0^2 - \omega^2 + \hat{\imath}\omega 2\omega_0\zeta_0} = \frac{P\alpha s_0 \hat{\imath}\omega \frac{d}{c}\cos(\phi)/m}{\omega_0^2 - \omega^2 + \hat{\imath}\omega 2\omega_0\zeta_0}. \quad \text{(III.8)}$$

It is assumed that the response is detected using capacitive sensing with a back electrode that is distributed over the entire diaphragm area. The electrical output is then proportional to the surface average of the deflection. If the nominal distance between the diaphragm and the back electrode is "h", and the bias voltage is $V_b$, as in equation (III.8), then the electrical sensitivity of the conventional microphone becomes:

$$S_0 = \frac{V_b}{hs_0}X_0\int_0^{l_x}\int_0^{l_y}\phi(x/l_x)\phi(y/l_y)dxdy = V_b X_0 \alpha/h, \quad \text{(III.9)}$$

where equation (III.5) is used to express the integral in terms of $\alpha$. Using equations (III.1) and (III.5) through (III.9) gives:

$$S_0 = \frac{V_b}{h}X_0\alpha = \frac{V_b}{h}\alpha^2\frac{P_{net}s_0/m}{\omega_0^2 - \omega^2 + \hat{\imath}\omega 2\omega_0\zeta_0} = \frac{V_b}{h}\frac{Ps_0\alpha^2\hat{\imath}\omega\frac{d}{2}\cos(\phi)/m}{\omega_0^2 - \omega^2 + \hat{\imath}\omega 2\omega_0\zeta_0}. \quad \text{(III.10)}$$

Inventive Design

Referring again to FIGS. 3*a* and 3*b*, predicted results for the sensitivity and noise performance of the differential microphone 30 are shown, and are hereinafter compared with that for the conventional differential microphone 10 illustrated in FIG. 1.

Microphone 30 consists of a fairly rigid diaphragm 32 supported at its center by beams 34 and 36 that have been carefully designed with torsion and transverse stiffnesses. A biased, spaced-apart backplate 35 forms the second element of a capacitance microphone. The overall dimensions of diaphragm 32 are 1 mm×2 mm, and the structure is constructed out of 1 $\mu$m thick polysilicon. The total area acted on by the dampers is thus, $s=2\times10^{-6}m^2$. The distance between the centers of the two sides is $d=1\times10^{-3}$m. The total mass is $m\approx2.5\times10^{-8}$ kg. The mass moment of inertia about an axis through the supports is $I=9.442\times10^{-15}$ kgm$^2$. The resonant frequency of the rotational mode is predicted to be 830 Hz and the frequency of the translational mode is 41,722 Hz. The rotational mode is the only mode having a frequency anywhere near the audible frequency range. This realizable structure thus behaves much like the idealized rigid bar depicted at the bottom of FIG. 1.

The diaphragm of the conventional microphone is assumed to be a 1 $\mu$m thick polycrystalline silicon membrane having dimensions 1×2 mm. Both microphones thus have the same area. The natural frequency of the membrane estimated using the finite element method was found to be≈10 kHz. The mass is $m_0=4.6\times10^{-9}$ kg.

Both microphones are assumed to have a bias voltage of $V_b=10$ volts and a backplate gap of h=5 $\mu$m. The damping constants in each design are selected to achieve critical damping so that the damping ratios are $\zeta=1$. This gives a damping constant for the proposed design of $R=9.8481\times10^{-5}$ N/M$^2$, and for the conventional microphone, $R_o=5.7805\times10^{-4}$ N/M$^2$. The sound speed is c=344 m/s. The required damping constants are well within the range of what can be achieved with the proper design of the porous back electrode.

Figure 3C:
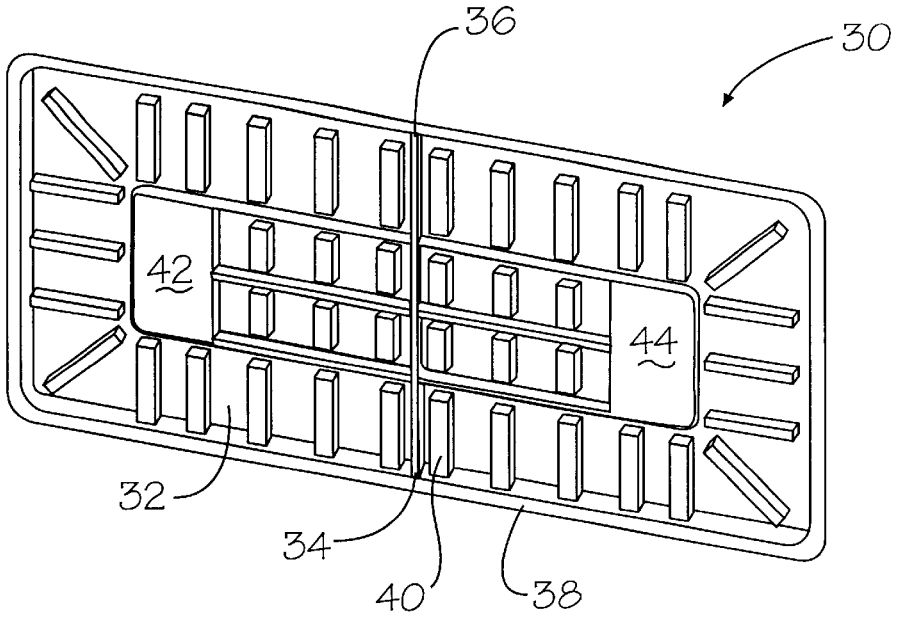
FIG. 3*c* depicts an alternate embodiment of the inventive differential microphone.
Figure 3D:
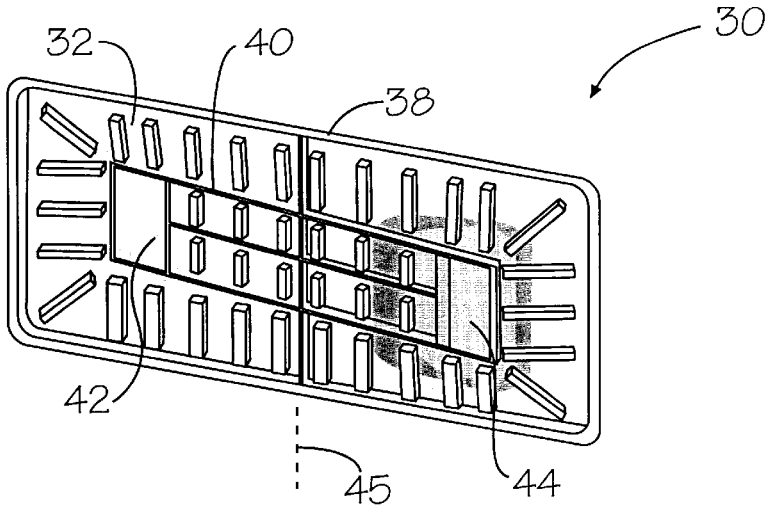
FIG. 3*d* depicts a perspective front view of the microphone of the invention with stiffeners and masses.

Another approach to constructing a differential microphone that responds with rotational motion about its centerline is shown in FIG. 3*c*. The operating principle is similar to that of the structure depicted in FIGS. 3*a* and 3*b* but in this case, the microphone diaphragm 32 is supported around its entire periphery 38 rather than only at flexible hinges 34 and 36. The structure 30 is designed with stiffeners 40 and masses 42, 44 that emphasize motion having a shape as shown in FIG. 3*d*. The two ends of the diaphragm 32 move in opposite directions and hence rock about the centerline 45.

Figure 4:
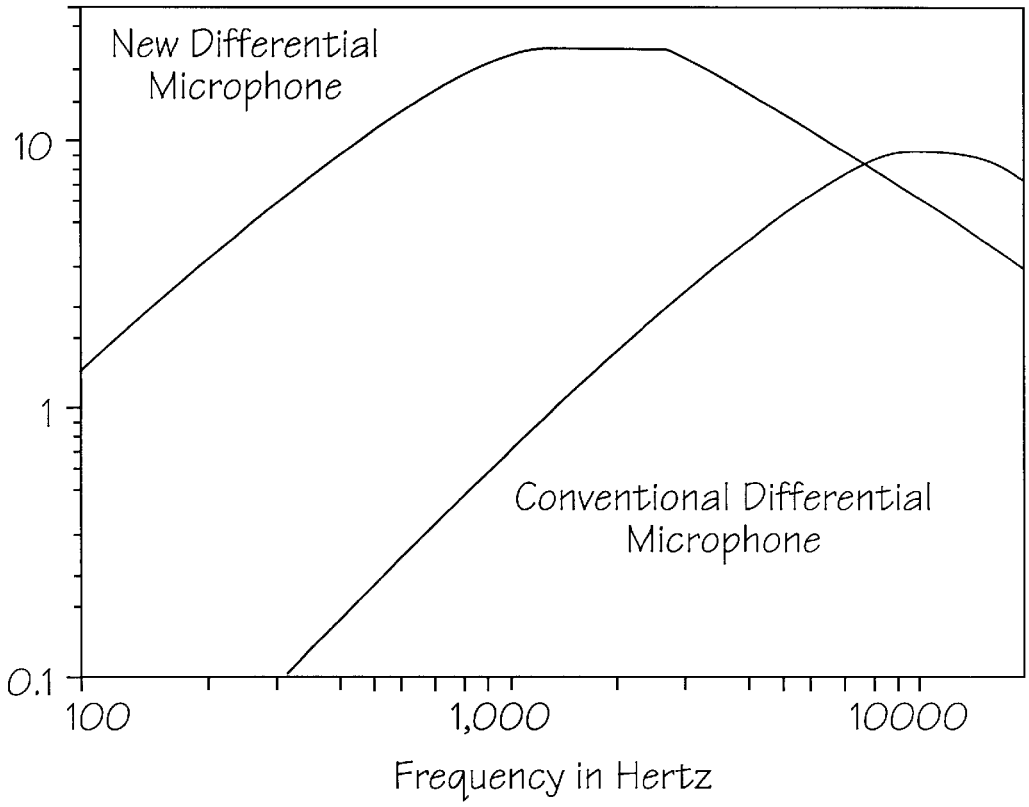
FIG. 4 illustrates a graph of the frequency response of the inventive differential microphone compared with a conventional differential microphone.

The predicted frequency response of the two designs, conventional and inventive, are shown in FIG. 4.

Figure 5:
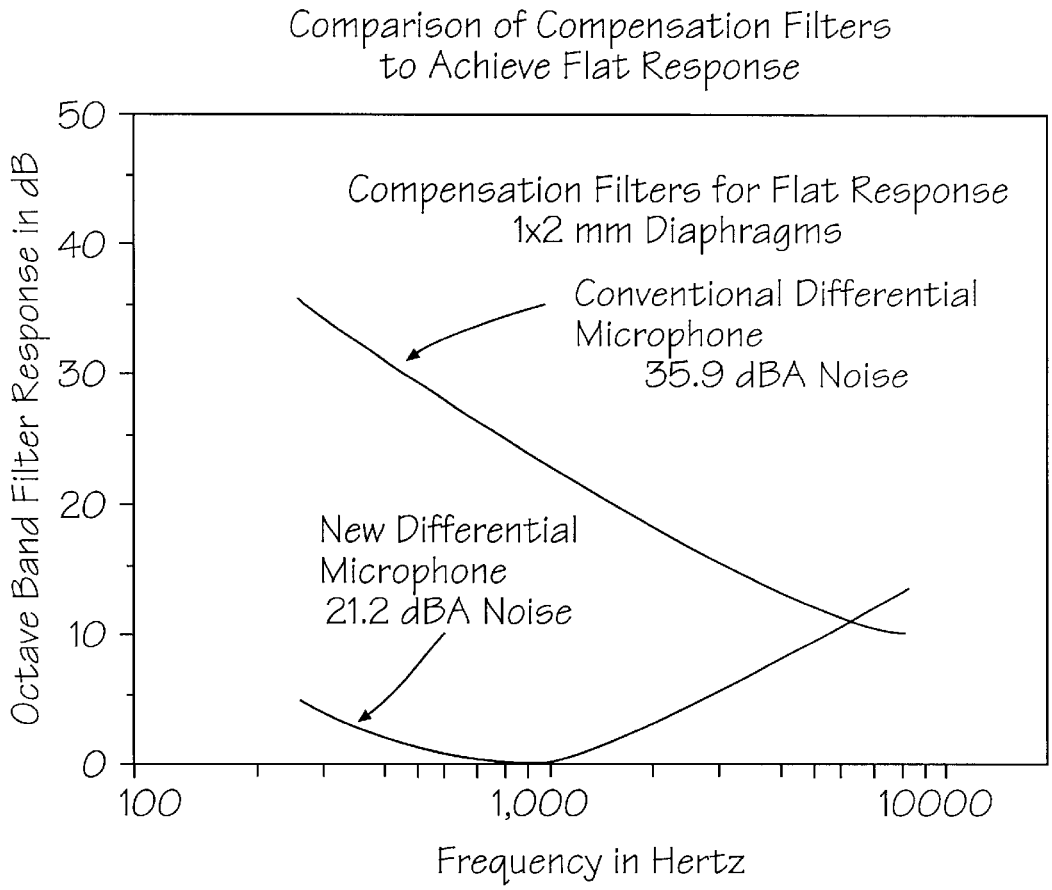
FIG. 5 depicts a graph of the compensation filter response of the differential microphone of this invention compared with a conventional differential microphone.
Figure 6:
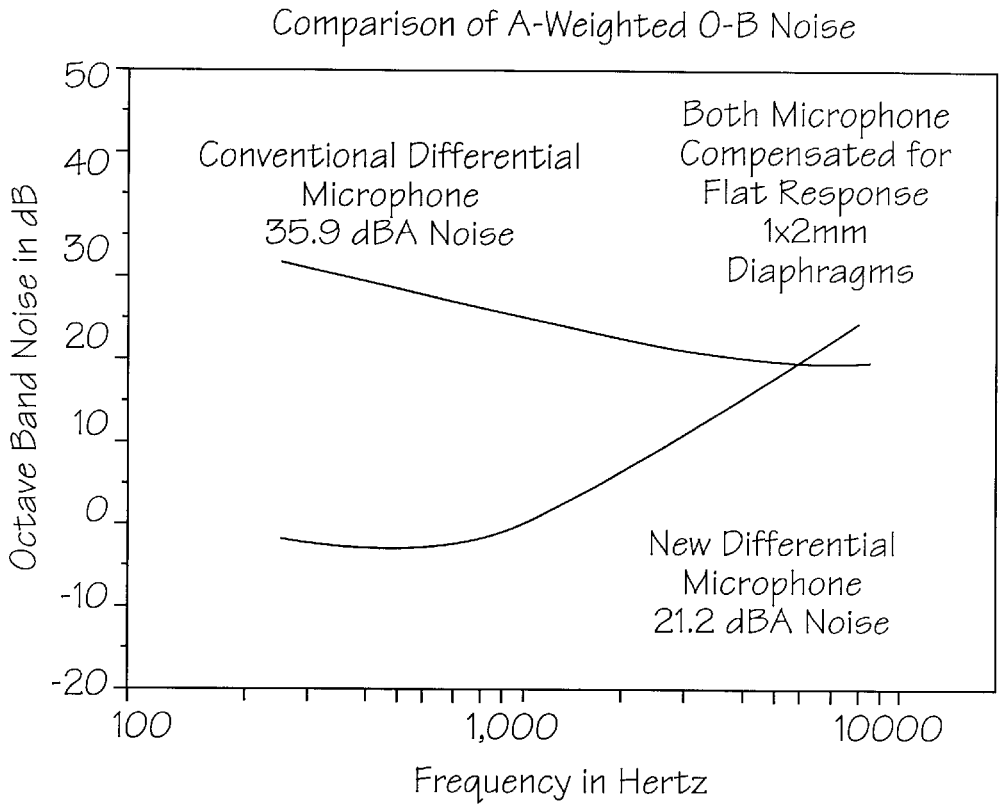
FIG. 6 shows a graph of the output noise of the inventive differential microphone compared to a conventional differential microphone.

It is assumed that the signals from each microphone 10, 30 will be compensated using a filter in order to achieve a flat frequency response over the 250 Hz through 8 kHz octave bands. The output levels of these filters are adjusted so that they are equal to the maximum output of the inventive microphone at its first resonant frequency, 830 Hz. The two filter responses are shown in FIG. 5. The low signal level of the conventional microphone 10 at low frequencies causes it to require over 30 dB of gain. FIG. 6 depicts both conventional and inventive microphones 10, 30 compared with respect to their noise outputs.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A miniature microphone comprising:

a) a thin, substantially rigid plate having a perimeter and two substantially parallel opposing faces;

b) means for supporting rotatively attached to said substantially rigid plate at two points along said perimeter such that a line connecting said two points forms an axis of rotation which divides each of said faces into a first region and a second region;

whereby a difference in sound pressures acting upon said first region and said second region of said two faces of said rigid plate creates a net moment and said rigid plate rotates about said axis of rotation in accordance therewith.

2. The miniature microphone as recited in claim 1, wherein said means for supporting exhibits both torsional and transverse stiffness.

3. The miniature microphone as recited in claim 2, further comprising means for damping operatively connected to at least one of said substantially rigid plates and said means for supporting.

4. The miniature microphone as recited in claim 2, wherein said means for supporting comprises a hinge.

5. The miniature microphone as recited in claim 4, wherein said hinge comprises a T-section beam.

6. The miniature microphone as recited in claim 3, wherein said miniature microphone further comprises a spaced-apart back plate electrode disposed adjacent and substantially parallel to said diaphragm, and wherein said means for damping comprises viscous forces of air moving between said back plate and said diaphragm responsive to movement thereof.

7. The miniature microphone as recited in claim 3, wherein said substantially rigid plate comprises polycrystalline silicon, has a substantially rectangular shape having a thickness of approximately one micron, and each of said two faces has a surface area of between approximately 1.5 and $2.5\times10^{-6}$ m$^2$.

8. The miniature microphone as recited in claim 3, wherein said microphone comprises a total mass of between approximately 2.0 and $3.0\times10^{-8}$ kg.

9. The miniature microphone as recited in claim 3, wherein a mass moment of inertia about said axis of rotation is in a range of between approximately 9.0 and $10\times10^{-15}$ kgm$^2$.

10. The miniature microphone as recited in claim 3, wherein said thin, substantially rigid plate has a resonant frequency in a translational mode higher than an upper operating frequency range at which said miniature microphone is required to operate.

11. The, miniature microphone as recited in claim 10, wherein said upper operating frequency range at which said miniature microphone is required to operate is in the range of approximately 20 Hz to 20 KHz.

12. The miniature microphone as recited in claim 3, wherein said thin, substantially rigid plate has a resonant frequency in a rotational mode of between approximately 300 and 3,000 Hz.

13. The miniature microphone as recited in claim 3, wherein said two points defining an axis of rotation are disposed such that said axis of rotation substantially bisects each of said two faces of said rigid plate.

14. The miniature microphone as recited in claim 3, wherein said rigid plate comprises stiffening structures disposed on at least one of said two opposing faces.

15. The miniature microphone as recited in claim 14, wherein said stiffening structures comprise at least one rib.

16. The miniature microphone as recited in claim 15, wherein said at least one rib is disposed in a predetermined pattern.

17. A miniature microphone comprising:

a) a thin, substantially rigid plate having a perimeter and two substantially parallel opposing faces;

b) means for supporting rotatively attached to said substantially rigid plate at least two points along said perimeter, said at least two points determining an axis of rotation of said substantially rigid plate, said axis of rotation dividing each of said faces into a first region and a second region;

whereby a difference in sound pressures acting upon said first region and said second region of said two faces of said rigid plate creates a net moment and said rigid plate rotates about said axis of rotation in accordance therewith.

18. The miniature microphone as recited in claim 17, wherein said means for supporting exhibits both torsional and transverse stiffness.

19. The miniature microphone as recited in claim 17, further comprising means for damping operatively connected to at least one of said substantially rigid plate and said means for supporting.

20. The miniature microphone as recited in claim 17, wherein said means for supporting comprises a hinge.

21. The miniature microphone as recited in claim 20, wherein said hinge comprises a T-section beam.

22. The miniature microphone as recited in claim 17, wherein said substantially rigid plate comprises polycrystalline silicon having a thickness of approximately one micron.

23. The miniature microphone as recited in claim 17, wherein said rigid plate comprises stiffening structures disposed on at least one of said two opposing faces.

24. The miniature microphone as recited in claim 23, wherein said stiffening structures comprise at least one rib.

* * * * *

UNITED STATES PATENT AND TRADEMARK OFFICE

CERTIFICATE OF CORRECTION

PATENT NO. : 6,788,796 B1
APPLICATION NO. : 09/920664
DATED : September 7, 2004
INVENTOR(S) : Ronald Miles It is certified that error appears in the above-identified patent and that said Letters Patent is hereby corrected as shown below:

Title page, after the title, the following paragraph should be inserted:

--STATEMENT OF GOVERNMENT INTEREST

This invention was made with government support under R01DC0392601 awarded by NIH/NIDCD. The U.S. Government has certain rights in the invention.--

Signed and Sealed this
Eleventh Day of September, 2012

David J. Kappos

David J. Kappos
*Director of the United States Patent and Trademark Office*